United States Patent [19]

Cholley

[11] Patent Number: 5,056,167

[45] Date of Patent: Oct. 15, 1991

[54] MODULAR ASSEMBLY FOR SWIMMING POOLS

[76] Inventor: Andre Cholley, 6 Rue du Gobenwald, 68580 Seppois Le Bas, France

[21] Appl. No.: 522,089

[22] Filed: May 11, 1990

Related U.S. Application Data

[63] Continuation of Ser. No. 137,210, Dec. 23, 1987, abandoned.

[30] Foreign Application Priority Data

Dec. 23, 1986 [FR] France ..... 8b18248

[51] Int. Cl.[5] ..... E04H 4/00

[52] U.S. Cl. ..... 4/492; 4/494; 4/496; 4/509; 4/622; 4/505

[58] Field of Search ..... 4/496, 509, 494, 488, 4/506, 507, 508, 509, 513, 541, 542, 544, 490, 491, 492, 539, 590, 622, 505; 52/169.7, 169.6, 169.1; 210/169, 416.2

[56] References Cited

U.S. PATENT DOCUMENTS

| | | | |
|---|---|---|---|
| D. 251,201 | 2/1979 | Mathis | 4/488 X |
| 1,976,168 | 10/1934 | Heijkenskjöld | 210/169 |
| 2,400,439 | 5/1946 | Romans | 210/169 |
| 3,036,712 | 11/1958 | Barbara | 4/490 X |
| 3,169,920 | 2/1965 | Payne | 210/169 |
| 3,374,492 | 3/1968 | Ruderian | 4/544 |
| 3,813,703 | 6/1974 | Beaudin, Jr. | 4/494 X |
| 3,925,830 | 12/1975 | Delaney | 4/622 X |
| 3,952,338 | 4/1976 | Troxclair | 4/492 |
| 4,001,899 | 1/1977 | Mathis | 4/489 |
| 4,087,870 | 5/1978 | Palmer, Jr. | 4/487 |
| 4,193,143 | 3/1980 | De Carvalho Vianna | 4/509 X |
| 4,233,694 | 11/1980 | Janosko et al. | 4/544 |
| 4,238,859 | 12/1980 | Badon, Jr. | 4/492 |
| 4,342,125 | 8/1982 | Hodge | 4/508 |
| 4,371,003 | 2/1983 | Goguen | 4/507 X |
| 4,527,297 | 7/1985 | Pettit | 4/496 |
| 4,552,658 | 11/1985 | Adlock | 210/169 |
| 4,599,835 | 7/1986 | Rinke | 52/169.7 X |
| 4,661,247 | 4/1987 | Weir et al. | 210/416.2 |
| 4,665,572 | 5/1987 | Davidson et al. | 4/496 X |

FOREIGN PATENT DOCUMENTS

| | | | |
|---|---|---|---|
| 0145619 | 5/1985 | European Pat. Off. | 52/169.7 |
| 1559143 | 11/1970 | Fed. Rep. of Germany . | |
| 2492438 | 4/1982 | France | 4/506 |
| 2531474 | 2/1984 | France | 52/169.7 |

*Primary Examiner*—Linda J. Sholl

*Attorney, Agent, or Firm*—Flehr, Hohbach, Test, Albritton & Herbert

[57] ABSTRACT

A modular assembly for use in a swimming pool is described. This assembly integrates the technical components and accessories for swimming pools, including at least one stair, a horizontal submerged bathing portion capable of supporting a user while sitting or lying, a filtration vat enclosing a water filtration system for filtering water to and from the swimming pool into and out of the modular assembly, and a technical vat enclosing a system for pumping and water recycling for pumping and recycling water between the swimming pool and the modular assembly. The assembly of the present invention can also include additional accessories such as a foot bath, a bathing therapy system, a countercurrent swimming system, a submerged lighting system, and a shower. The entire module includes connections for water intake and water discharge for passage of water to and from the swimming pool, and electrical power connections for accessing electrical power.

13 Claims, 3 Drawing Sheets

FIG. 1
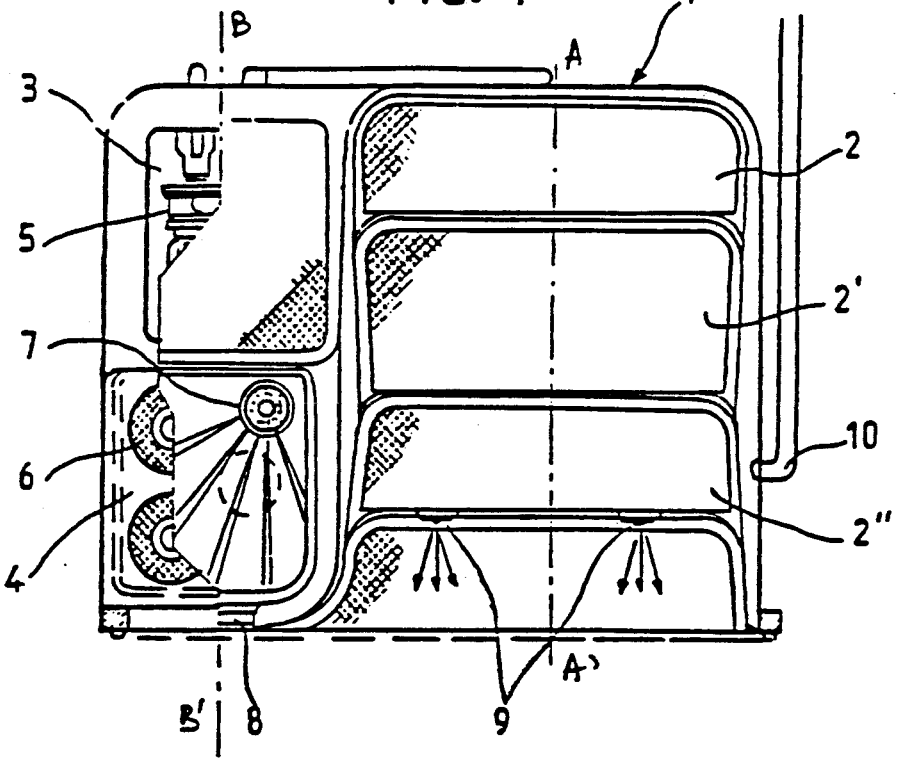
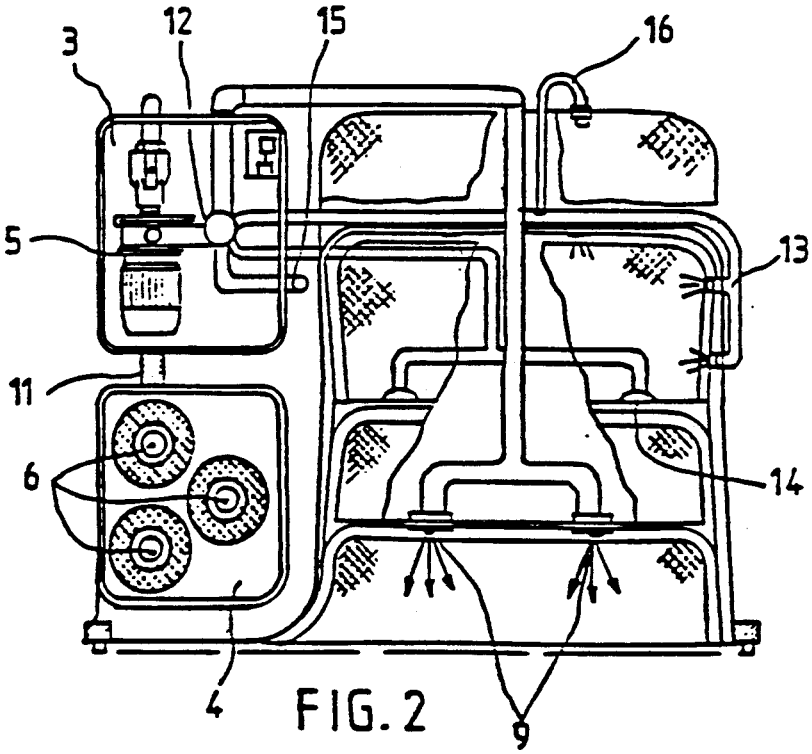
FIG. 2

MODULAR ASSEMBLY FOR SWIMMING POOLS

This is a continuation of application Ser. No. 137,210 filed Dec. 23, 1987, now abandoned.

BACKGROUND OF THE INVENTION

This invention relates to a modular assembly comprising all the technical elements and accessories usually mounted in the vicinity of a swimming pool to perform the various functions of filtration, safety and attractiveness.

The usual techniques for providing such technical elements and accessories involve a small building in the vicinity of the pool wherein the necessary technical elements are mounted, such as feeding pumps, filters, and the like. In addition, many other accessories such as stairs, submerged lighting, foot baths, countercurrent swimming systems, showers, foot baths for children, bathing therapy devices, and the like are arranged around the swimming pool in different areas. For installation, all these accessories require arrangements and fittings at the pool itself, which involves expensive foundation work, and the accessories are difficult to reach in case they need maintenance and repairs.

SUMMARY OF THE INVENTION

The purpose of the present invention is to provide a complete organization of all the technical and optional elements and accessories at a competitive cost with a rational and new design of a modular assembly.

To achieve this purpose, the present invention provides unique and independent modular groups within the space required for the stairs of swimming pools, in which the usually peripheral or submerged components which provide the water feeding systems and the swimming pool accessories may be installed.

The invention also provides a new integrated arrangement of all the components together, in a preferred form of the module, so that the module may be used as a part of the swimming pool itself, instead of being added in a separate building or requiring installation in separated area of the swimming pool.

BRIEF DESCRIPTION OF THE DRAWINGS

The invention will be understood by reference to the following detailed description, and the attached drawings, in which:

FIG. 1 is a partially cut away view of the upper part of a module according to the invention;

FIG. 2 is a view of the upper part of said module, showing additional details;

DESCRIPTION OF PREFERRED EMBODIMENTS

Figure 3:
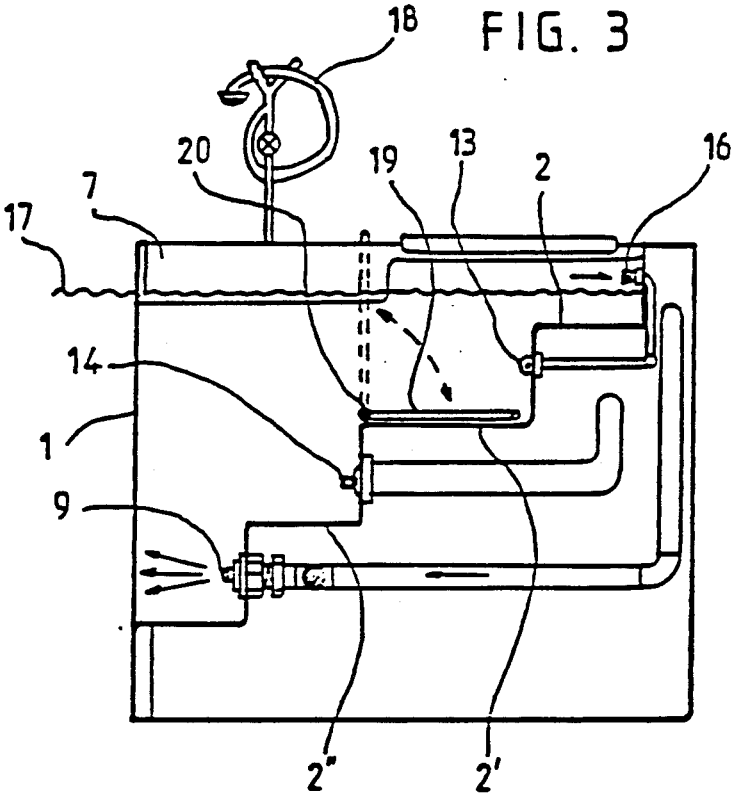
FIG. 3 is a sectional view taken substantially along line A—A' of FIG. 1.

Referring to the drawings, module 1 is shown having a generally cubic form, but it may also have a generally or partially cylindrical or elliptical or another form. The module is preferably constructed of a reinforced polyester resin, and a part of it forms stairway 2 having several steps adjacent technical vat 3 and filtering vat 4. Technical vat 3 has in its internal volume feeding pump 5 and the necessary valves. Filtering vat 4 has in its internal volume several filtering cartridges of antifouling folded fabric which insure a better filtration, and filtering vat 4 is covered by a spillway 7 serving as a foot bath which is equipped with a safety device 8 to prevent the pump from draining in case of lack of water. The riser of a step of the stairway may include delivery nozzles 9 and may receive various accessories such as bathing therapy devices, submerged searchlights, a frame structure delimiting a foot bath, or nozzles for countercurrent swimming. In the upper part of the module, as shown in FIG. 1, at the water level, an overflow opening 10 prevents overflowing caused by precipitation.

Referring more specifically to FIG. 2, the details of the circulation piping system, the bathing therapy system, the countercurrent swimming system, and the sewerage system are shown.

Waterproof filtering vat 4 contains filtering cartridges 6 connected by pipe 11 to feeding pump 5 contained in technical vat 3. In addition to the feeding pump, technical vat 3 also houses a multichannel valve 12 which permits directing the water from the pump either toward delivery nozzles 9 situated in the last riser of the step or toward bathing therapy nozzles 13, or toward countercurrent swimming nozzles 14, or toward sewerage system 15. Ventilation aperture 16 mounted on the bathing therapy pipe permits modulation of the air intake in the circuit to oxygenate and emulsify the water.

FIG. 3 shows module 1 with the risers of steps 2 receiving delivery nozzles 9, countercurrent swimming nozzles 14, and bathing therapy nozzles 13 together with adjustable ventilation aperture 16 of the bathing therapy system mounted just above water level 17. It is also possible to see spillway/foot bath 7 which may be provided with shower 18. Step 2' of the stairs may receive a wall 19 articulated on hinge 20 which, in an upright position, delimits a foot bath for children.

Figure 4:
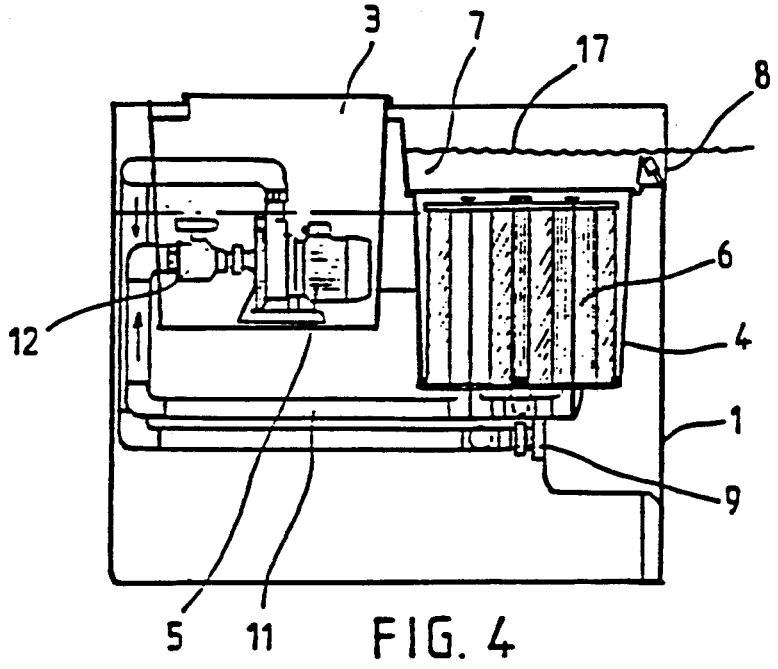
FIG. 4 is a sectional view taken substantially along line B—B' of FIG. 1.

FIG. 4 shows module 1, having waterproof filtering vat 4 containing filtering cartridges 6, pipe 11 feeding filtered water to the pump, pump 5 and multichannel valve 12, with the filtered water being directed by delivery nozzles 9 at the riser of a stair. Safety system 8 comprising an adjustable floating valve arranged in a partitioned portion of the spillway prevents a water shortage to the pump when the level of the swimming pool is below the upper level of the spillway. The safety valve is lightened in its upper part by a buoyant material and is fixed at its base along a horizontal axis. As the water level is lowered, the valve inclines more or less toward the inner part of the foot bath, proportionally to the water supply required to feed the pump.

Figure 5:
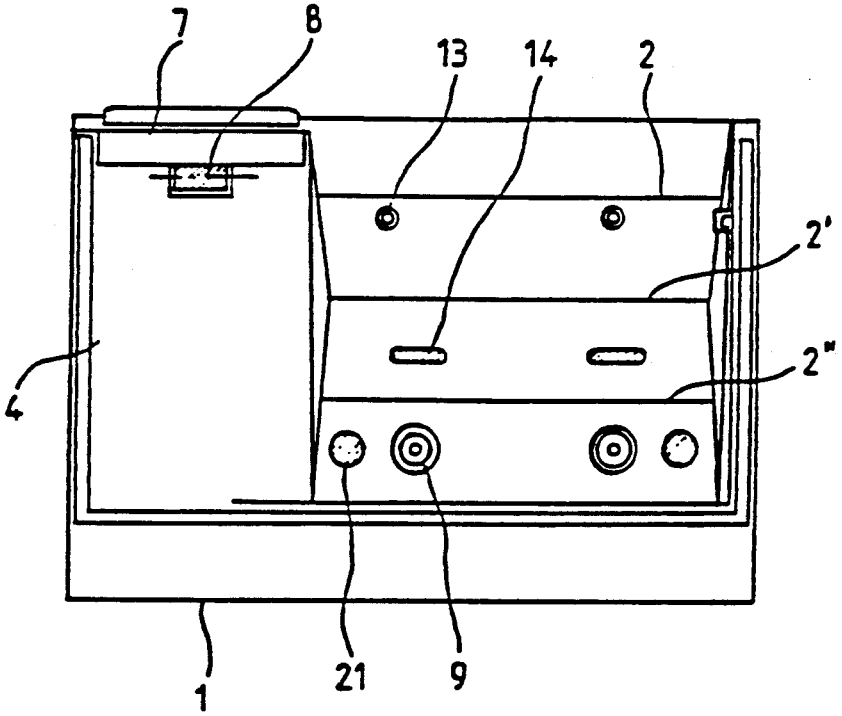
FIG. 5 is a front view of the module.

FIG. 5 shows a front view of module 1 having waterproof filtering vat 4 covered by spillway/foot bath 7, safety system 8 for detecting and preventing a shortage of water, steps of the stairs receiving delivery nozzles 9, countercurrent swimming nozzles 14, bathing therapy nozzles 13, and submerged lighting 21.

As for filtration, the modular assembly functions as follows: the water level is at 1 or 2 cm above the spillway edge when the pump is off; when activated it provokes, by aspiration, a lowering of the foot bath level which induces dust and other debris which may be at the surface of the water to the spillway by a skimming effect, where the debris falls with the water on the bottom of the foot bath, which is provided with a drain preventing passage of important impurities such as dead leaves, and the like.

The water then passes through the filtering cartridges upstream from the pump, which have a very low clogging threshold. Additionally, the large filtration surface permits a slow speed for the passage of running water to provide better filtration.

The present invention may be used generally for replacing the usual technical components of swimming pools.

This prefabricated module provides lower manufacturing costs and significantly reduces the time required for fitting and installation.

To prevent any malfunction of the system according to this invention, in case of an unexpected, accidental or excessively fast decrease of the water level in the pool, a lever control device is preferably mounted in module 1 to control the water level 17 in the foot bath.

I claim:

1. A modular assembly for use in a swimming pool comprising a water filtration system for filtering water between said swimming pool and said module assembly and a water pumping and recycling system for pumping and recycling water between said swimming pool and said modular assembly, integrated in a prefabricated module having a substantially horizontal submerged bathing portion capable of supporting a user while sitting or lying, formed for at least partial submersion in a swimming pool, said prefabricated module comprising at least one stair, a filtration vat enclosing said water filtration system, and a technical vat enclosing said water pumping and recycling system, water intake means and water discharge means for passage of water to and from said swimming pool, a foot bath, a countercurrent swimming system, and an electrical power connection means for accessing electrical power, said water pumping system further comprising means for drawing water from said foot bath through a plurality of filtering cartridges, said water being discharged into said swimming pool through nozzle means.

2. A modular assembly according to claim 1 wherein said prefabricated module has a plurality of stairs additionally, a bathing therapy device, and a submerged lighting system.

3. A modular assembly according to claim 1 wherein said filtration vat is located upstream from said water pumping and recirculation system and includes a plurality of water filtration cartridges.

4. A modular assembly according to claim 3 wherein said filtration vat is covered by a spillway serving as a footbath.

5. A modular assembly according to claim 4 additionally comprising a safety valve mounted in proximity to said spillway for detecting and preventing a shortage of water in said spillway.

6. A modular assembly according to claim 1 wherein said technical vat is waterproof and encloses a water pump connected to a multichannel valve for distributing water for different uses.

7. A modular assembly according to claim 2 wherein bathing therapy nozzles are mounted in at least one riser between adjacent stairs.

8. A modular assembly according to claim 7 wherein the stair adjacent and immediately below said bathing therapy nozzles is enlarged to accommodate a person using said bathing therapy devices.

9. A modular assembly according to claim 1 wherein said countercurrent swimming system includes nozzles mounted in at least one riser between adjacent stairs.

10. A modular assembly according to claim 2 wherein water delivery nozzles for circulating water from said technical vat enclosing said water pumping and recirculation system are mounted in at least one riser between adjacent stairs.

11. A modular assembly according to claim 2 wherein searchlights forming part of said submerged lighting system are mounted in at least one riser between adjacent stairs.

12. A modular assembly according to claim 1 wherein said prefabricated module additionally includes a swimming pool drainage system.

13. A modular assembly according to claim 1 additionally comprising a water level control device mounted on said prefabricated module to monitor and control the water level in the swimming pool.

* * * * *